US009409634B1

(12) United States Patent
Moses

(10) Patent No.: US 9,409,634 B1
(45) Date of Patent: Aug. 9, 2016

(54) BOUY BOARD

(71) Applicant: Manuel Brad Moses, Flushing, NY (US)

(72) Inventor: Manuel Brad Moses, Flushing, NY (US)

( * ) Notice: Subject to any disclaimer, the term of this patent is extended or adjusted under 35 U.S.C. 154(b) by 0 days.

(21) Appl. No.: 14/629,136

(22) Filed: Feb. 23, 2015

(51) Int. Cl.

| | |
|---|---|
| ***B63H 11/02*** | (2006.01) |
| ***B63B 35/73*** | (2006.01) |
| ***B63H 25/02*** | (2006.01) |
| ***B63H 25/46*** | (2006.01) |
| ***B63B 3/14*** | (2006.01) |
| *B63H 11/00* | (2006.01) |
| *B63B 29/04* | (2006.01) |
| *B63B 17/00* | (2006.01) |
| *B63B 43/00* | (2006.01) |

(52) U.S. Cl.
CPC ..... *B63B 35/731* (2013.01); *B63B 3/14* (2013.01); *B63H 11/02* (2013.01); *B63H 25/02* (2013.01); *B63H 25/46* (2013.01); *B63B 2017/0045* (2013.01); *B63B 2029/043* (2013.01); *B63B 2043/006* (2013.01); *B63H 2011/008* (2013.01); *B63H 2025/024* (2013.01)

(58) Field of Classification Search
CPC ..... B63H 11/00; B63H 11/02; B63H 11/107; B63H 25/00; B63H 25/46; B63H 23/26; B63H 21/22; B63H 11/04; B23B 35/73
USPC ..... 114/151; 440/38, 40, 42
See application file for complete search history.

(56) References Cited

U.S. PATENT DOCUMENTS

| | | | | |
|---|---|---|---|---|
| 4,541,357 | A * | 9/1985 | Stanton | B63B 1/34 114/67 R |
| 6,146,219 | A * | 11/2000 | Blanchard | B63H 11/11 114/151 |
| 6,530,812 | B2 * | 3/2003 | Koyano | B63H 25/46 440/38 |
| 8,490,558 | B2 * | 7/2013 | Foley | B63H 25/46 114/151 |
| 2011/0056422 | A1 | 3/2011 | De Masi, Sr. | |

* cited by examiner

*Primary Examiner* — Lars A Olson
(74) *Attorney, Agent, or Firm* — Ernesto Garcia

(57) ABSTRACT

An enclosed water jet craft allows a passenger to surf waves while having multi directional control to tumble and to launch the craft up into the air. Several valves contained within and under a carriage of the craft are controlled by the manipulation of handlebars containing bearing sensors that control opening and closing jet ports. The water jet craft itself is reinforced for passenger safety and the passenger is harnessed in while using the craft to protect the passenger during launch and tumble while wave surfing.

15 Claims, 5 Drawing Sheets

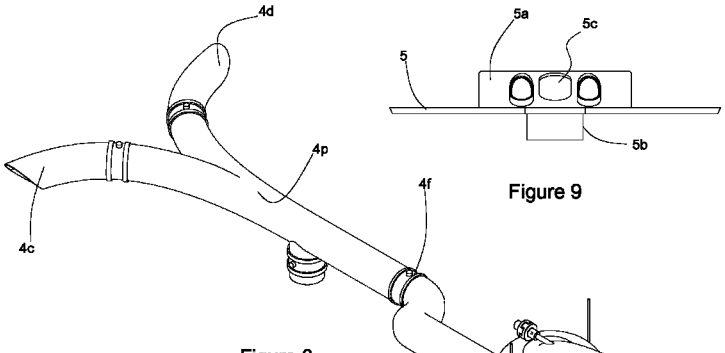
Figure 8
Figure 9
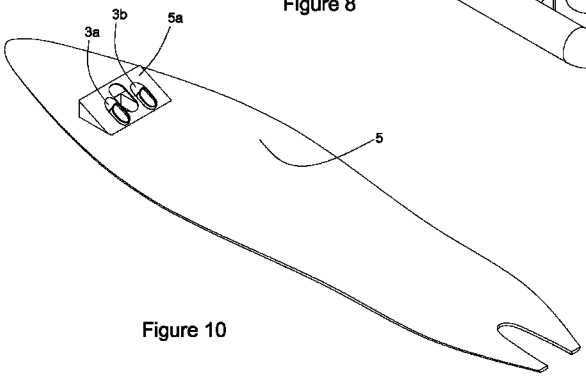
Figure 10
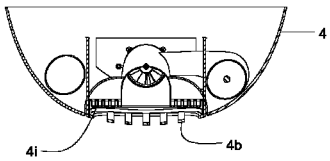
Figure 11
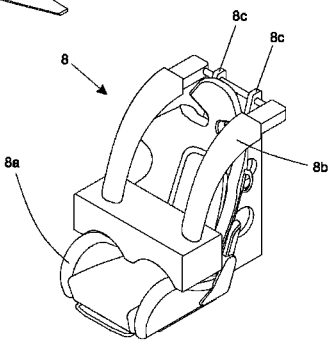
Figure 12

BOUY BOARD

FIELD OF THE INVENTION

The invention is related to water propelled recreational crafts known as jet skis. More specifically this invention is related to an enclosed jet ski, and more distinctly as a passenger enclosed wave surfing product.

BACKGROUND OF THE INVENTION

Jet skis are watercrafts that use water as a medium of propulsion. This propulsion has in the prior art only taken advantage of rear propulsion. This invention makes up for this lack of physical advantage afforded by water in some several important respects.

The advantage of a jet ski watercraft is that it operates in a medium of water. Water can be used as a means of propulsion and cushion (e.g. water beds), and for complex and sudden change in the speed and direction of the vessel that is cushioned on impact. The prior art has not taken full advantage of the physical medium in which these crafts operate. In order to take advantage of the water, as propulsion medium and by and through waveforms, the Buoy Board specifications has now been designed.

A known flying watercraft is by De Masi, Sr., US Publication, 20110056422. This craft utilizes a telescoping water intake for the propulsion system. De Masi's craft is designed as both an open body concept and closed body concept and mainly uses one rear jet as commonly know with all jet skis. This craft uses an air pump to feed air into the craft to help occupants breath and feed the motor as well.

SUMMARY OF THE INVENTION

The prior art includes enclosed Jet Skis, but not enclosed Jet Skis that are shock proof to the extent of protecting a passenger(s) in heavy surf and sudden speed and directional changes; hence the name Buoy Board, which always rights itself and is tough and durable.

The craft has durability not before seen in the prior art; allowing the craft to take a 20-foot wave for a unique thrill ride, and always right itself up and securing the passenger in a safe, comfortable, and thrilling ride. The prior art primarily concerned rear propulsion that limits the directional control of the craft to a forward or circular path.

The craft has water exhaust side ports or jets, and at least one port or jet underneath the carriage of the craft, which allows it to thrust water out on the sides, and to tumble left or right. The port underneath the craft allows the craft to launch—up into the air, without losing thrust by reasons of an intake probe that telescopes down into the water during the launch phase.

These ports and associated water thrusting pressures are controlled by a series of valves under the carriage of the craft that are also connected to a series of associated servo motors and solenoids that open and close the valves as is indicated by the pilot directional control steering mechanism. The pilot operates the craft by using specially designed ergonomic handlebars that is in one corresponding accord with the sitting position of the human form. The form of the handlebars resemble curved ones found on an English racing bike but uniquely novel in reverse.

The handlebars serve a dual safety purpose. Built into the handle bars steering columns is a hydraulic brake plunger that provides appropriate tension to the handle bar steering allowing the pilot to grip and hold the steering mechanism during the launch or tumble phase or wipe out phase of the craft during high speed operation or heavy or high surf. This brake mechanism is engaged when pressing a button switch on top of the handlebar itself. The brake mechanism also includes a safety feature that allows the craft to be turned with the application of appropriate physical force if the brake locks down and does not release, so that in essence the pilot can still turn the craft back to shore in an emergency should the brake lockdown and not release and malfunction.

The steering system includes two distinct bearings sensor control mechanisms. The upper most sensor is contained in the outer casing or spherical socket of a ball joint. Out from the socket extend out two arms of the steering mechanism or handlebars. The bearings are housed in a bearing harness whose assembly is accomplished by two plastic interlocking clips that secure the bearing to the spherical socket. The bearings ride on a circuit board racer whose circuitry is linked to a computer chip that sends electronic signals to the solenoids that control the servo motors and in turn control the various butterfly valves, which open and close the flow control of water thrusters to the right or left ports for tumbling the craft or rear port for ordinary forward directional controls. There is also a lower bearing sensor located at the base of the steering column that opens or closes that undercarriage ports.

The steering bearing sensors operate this way. The pilot holds both hands of the steering mechanism. Turing one of the handle bars in towards the left side of your chest, while level, turns the craft to the left. Turning one of the handlebars in towards the right side of your chest, while level, turns the craft to the right.

Pulling back on the handlebars engages the bearings on the lower portion of the steering column, and consequently opens the ports on the under carriage of the craft, launching the craft up.

Tilting the handle bar down and left; opens the right side port and tumbles the craft to the left. Tilting the handle bar down and right opens the left side port and tumbles the craft to the right.

There are two buttons on the tops of the grips of the handle bar controls. The button on the left can be readily engaged by the left thumb, and raises the RPM's of the motor into overdrive, providing additional acceleration during the launch phase of the vehicle. The button above the right hand can be readily engaged by the right thumb, engages and disengages the hydraulic brake, to stabilize the handle bar as a grip and hold safety feature during the tumble phase of the craft.

An additional feature of the craft is the body steel cushioned body harness that secures the chest and legs of the human form; during tumble and severe shock during turbulent, tumble, and wipe out we see contained in large waveforms. A unique feature of this body harness is that it retracts into the roof of the vessel, and is easily pulled down into place by the seated pilot.

A unique feature of human body protection is in two recessed footrests. The two footrests are angled and recessed into the floor of the vessel or placed on a pedestal. The heels can as well be recessed into a lower portion of the craft, while the top half of the feet protrude up. The pilot's bare feet are placed into a foam fitted cushion that is sized to the passenger. Each of the foam fitted shoe cushions snap in and out—of the floor recessed foot compartments, for easy sizing and cleaning. They hold the feet in place during tumble.

An additional unique aspect of this recessed and angular footrest is that the passenger can press down onto both their feet to help secure and stabilize them during a tumble and wipe out phase of the ride. In essence, this provides an additional securement to hold on—by pushing down on your feet and at the same time holding when the steering mechanism becomes locked while being harnessed into place as well.

An important feature of the vessel is the ability to operate while submerged. This is a necessary feature and takes into account that this vessel may operate in heavy surf. This ability to operate submerged means that the air intake port on the top of the craft has a small topside port hatch involved in air exchange: one for air intake that opens and closes by virtue of an optical sensor that detects a laser once the laser passes through a bubble moving in a donut shaped container filled with opaque fluid. This optical sensor is connected to the donut shaped container, which in turn is fixed to the body of the craft. When the optical sensor senses, it signals that the craft begins to tilt to one side during tumble. When this happens, the top port closes preventing water from flooding the passenger compartment. The optical sensor is bidirectional and dependent on the direction of tumble. Associated with this conduit airway are positive air vent fans taking air from the top into the enclosed passenger compartment and back out the rear of the craft. Within this vent conduit is a sump and associated pump to rid the air conduit of water. The air is exchanged and exited from the enclosed compartment via a conduit that has a rear craft port check valve to prevent water from flooding back into the craft during times of submersion.

The engine or engines can also operate submerged without stalling, as the engine has an air canister that has an associated air pump to feed the carburetor and motor. This distinction is a necessary feature, as the vessel may be submerged for an extended period of time, and maintaining operational control for example in the collapsed tube of a wave lends to the thrill and aids in effective operation. It should be noted that the craft can include a two passenger model that is useful for pilot training or certification.

BRIEF DESCRIPTION OF THE DRAWINGS

FIG. 8 shows an isometric view of the propelling system.

FIG. 9 shows a front view of a foot restrainer.

FIG. 10 shows an isometric view of a floor used in the buoy board.

FIG. 11 shows cross-sectional view 11-11 shown in FIG. 6.

FIG. 12 shows a seat restrainer used in the buoy board.

DETAIL DESCRIPTION OF THE DRAWINGS

Figure 1:
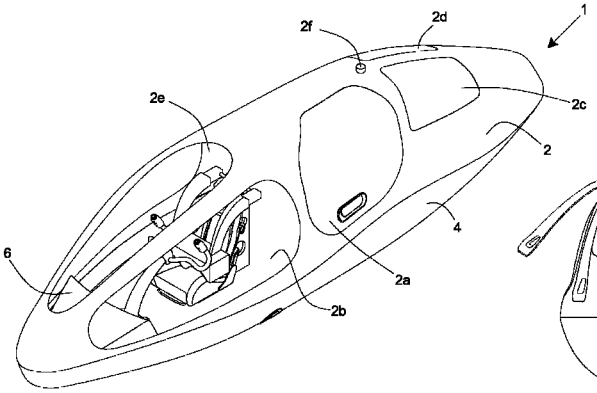
FIG. 1 shows an isometric view of the buoy board.
Figure 2:
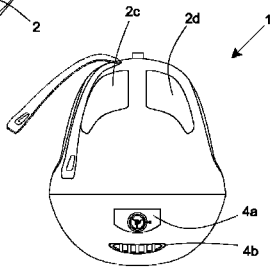
FIG. 2 shows a rear view of the buoy board.

FIG. 1 shows an overall view of the buoy board or craft 1. The craft 1 comprises a top shell 2 and a bottom shell 4. It should be noted that the method of joining the two shells can be made with many different processes or connections and will not be discussed. One of ordinary skill in the art will know best how to join the two shells 2, 4. In this design of craft, the top shell 2 includes several front windows 2*b*, 2*e* 2*f* and rear windows 2*c*, 2*d*. The windows 2*b*-2*f* are view shields made of polymer material and deep recessed into the top shell 2. The design further includes a hatch door 2*a* that hinges horizontally to the craft 1 as seen in FIG. 2. As customary, the door 2*a* has a latch 2*f*. A dashboard 6 provides the pilot with sensors and buttons to control aspects of the craft. As customary, the craft includes a steering system 10.

Figure 4:
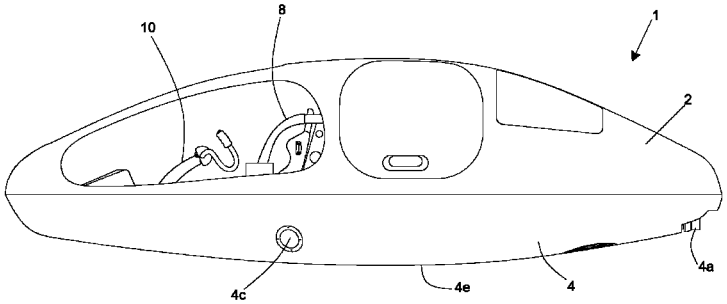
FIG. 4 shows a side view of the buoy board.
Figure 5:
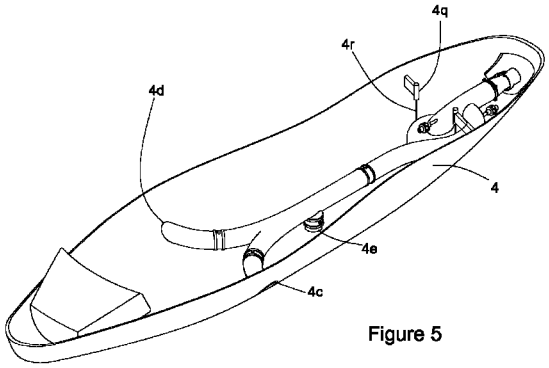
FIG. 5 shows an isometric view of the bottom half of the buoy board.
Figure 7:
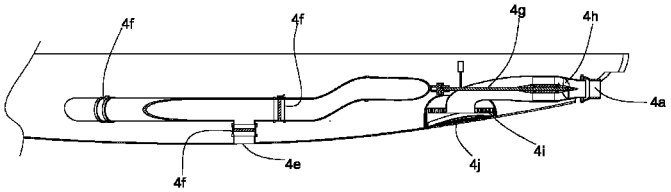
FIG. 7 shows cross-sectional view 7-7 shown in FIG. 6.

On top of the top shell 2 is an air inlet port 2*f* to feed both the pilot and the engines 20, 22. It should be noted that any type of engine can be used to provide power to shafts 4*g* which propel impellers 4*g* in FIG. 7. At the bottom of the bottom shell 4 is a water intake port 4*b* as seen in FIG. 2. At the rear of the bottom shell 4 is a rear jet 4*a* as commonly found in jet skis and are pivotable to make the ski go left or right. The bottom shell 4 further includes side jets 4*c*, 4*d*, which can be seen in FIG. 5. Adjacent to the water intake port 4*b* is a bottom jet 4*e* as seen in FIGS. 4, 5, and 7.

Figure 3:
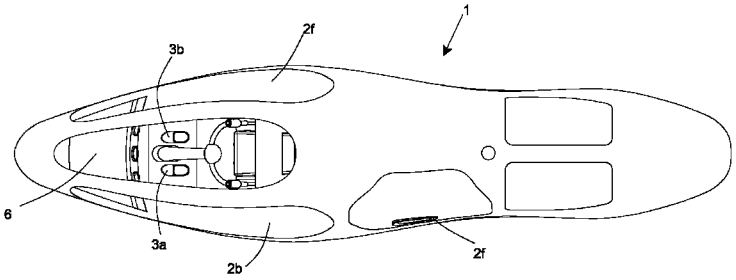
FIG. 3 shows a top view of the buoy board.

As seen in FIGS. 3, 9, and 10 is a floor 5 which includes a pedestal 5*a* keeping a foot restraining system comprising two footrests 3*a*, 3*b* of which includes a housing and a padding that custom fits the pilot's feet. The craft 1 employs a seat restraining system 8 as commonly found in roller coasters. The seat restraining system, as seen in FIG. 12 in detail, features a pair of backbones 8*c* that keep a hinging chest rest 8*b*, which protects a pilot when sitting on seat 8*a*.

Figure 6:
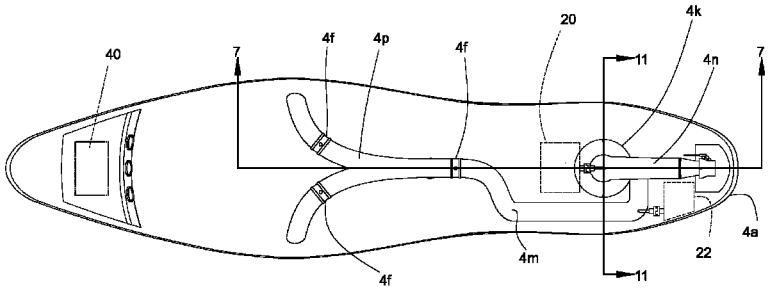
FIG. 6 shows a top view of the bottom half of the buoy board.

FIGS. 5-8 show details of the propelling system. The water intake port 4*b* includes a dome housing 4*k* that is sealed relative to the bottom shell 4. A first channel 4*n* projects from the dome 4*k* and houses an impeller 4*h*, which pushes water through jet port 4*a*. A drive shaft 4*g* projects through the first channel 4*n* which then connects to engine 20. At the end of the first channel 4*n* is connected a flexible bellows 4*i* that is in continuous flow. The flexible bellows 4*i* makes the intake port 4*b* to be telescoping by the use of hydraulic cylinders 4*q*. A piston 4*r* of the hydraulic cylinders 4*q* are connected to a grating 4*j*, which is connected to the end of the flexible bellow 4*i*. The grating 4*j* prevents any debris from entering through the water intake port 4*b*. As seen in FIG. 6, a second channel 4*m* extends from the first channel 4*n*, which contours and has a portion that is parallel to the first channel 4*n*. Similar to the first channel 4*n*, the second channel 4*m* houses another impeller 4*h* except that its shaft 4*g* extends through the second channel 4*m* in an opposite direction to that impeller 4*h* in the first channel 4*n*. The impeller 4*h*, in the second channel 4*m*, is driven by a second engine 22. The craft will have two independent engines 20, 22 to activate the jets. In particular, one of the engines 20 will activate the back port and the other engine 22 will activate the side ports and bottom port.

The second channel 4*m* connects to a Y-channel 4*p*, which divides the flow into the left jet 4*c* and right jet 4*d*. Between the Y-channel 4*p* and the second channel 4*m* is a butterfly valve 4*f* to block the flow path. It should be noted that the butterfly valve 4*f* can be manipulated by hydraulics, pneumatics, servo motors, or solenoids. The bottom jet 4*e* projects from the Y-channel 4*p* and is similar controlled by another butterfly valve 4*f*. As seen in FIG. 6, the left jet 4*d* and the right jet 4*c* similar to the bottom jet 4*e* are blocked off by butterfly valves 4*f*. The butterfly valves 4*f* are controlled based on the way the pilot handles the steering system 8 as will be later discussed.

Figure 13:
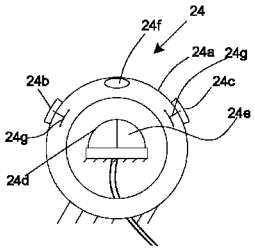
FIG. 13 shows a front view of a tumble sensor.
Figure 14:
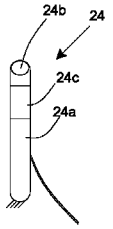
FIG. 14 shows a side view of the tumble sensor.
Figure 15:
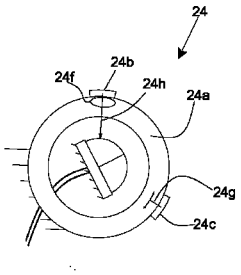
FIG. 15 shows a front view of the tumble sensor when the craft is in a tilted position.

FIGS. 13-15 show a tumble sensor 24 that controls the opening and closing of the air intake 2*f*. The tumble sensor 24 includes a hollow donut 24*a* made of glass or a strong clear plastic that is fixed to the craft 1. The hollow donut 24*a* houses an opaque fluid and a bubble 24*f* that moves freely when the craft 1 tilts. Attached to the donut 24*a* is a pair of lasers 24*b*, 24*c* that when projected and hit the opaque fluid scatters the laser beam 24*g*. At the center of the donut 24*a* is a pair of beam detectors 24*d*, 24*e* that is fixed to the craft 1. The operation of the tumble of the sensor 24 is as follows. When the craft 1 has tilted to the left side or right side, the donut 24*a* and detectors follow. The bubble 24*f* stays stationary to gravity and moves relative to the donut 24*a*. When the beam 24*h*, as shown in FIG. 15, hits the bubble 24*f*, the beam 24*h* passes through the bubble 24*f* into the beam detector 24*d*. When that occurs, it registers a signal to control a hatch of the air intake port.

Figure 16:
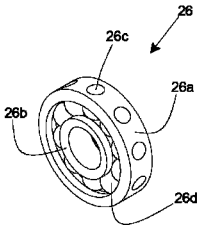
FIG. 16 shows a lower bearing sensor system as part of a steering mechanism.
Figure 17:
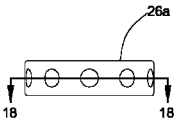
FIG. 17 shows a top view of the lower bearing sensor system.
Figure 18:
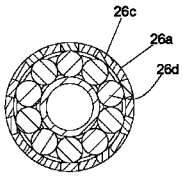
FIG. 18 shows cross-sectional view 18-18 shown in FIG. 17.
Figure 19:
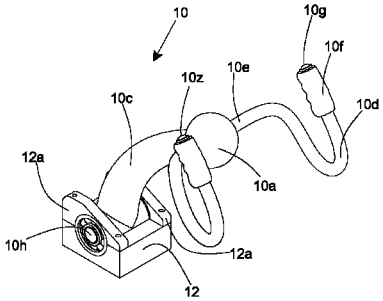
FIG. 19 shows an isometric view of a steering mechanism.
Figure 20:
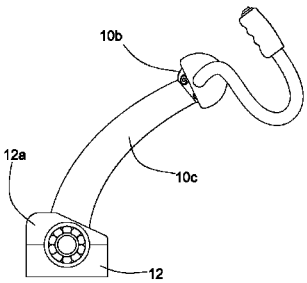
FIG. 20 shows a side view of the steering mechanism.
Figure 21:
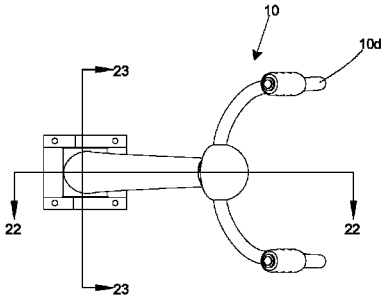
FIG. 21 shows a top view of the steering mechanism shown in FIG. 19.
Figure 22:
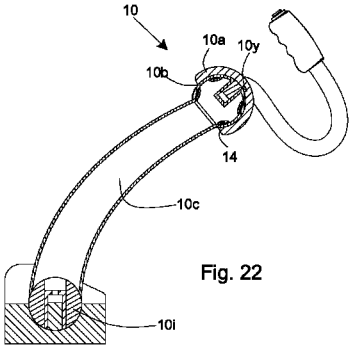
FIG. 22 shows cross-sectional view 22-22 shown in FIG. 21.
Figure 23:
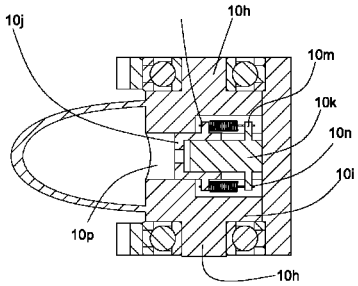
FIG. 23 shows blown-up cross-sectional view 23-23 shown in FIG. 21.

FIGS. 19 and 20 show the steering system 10 including a steering column 10*c*, a socket 10*a*, ball 10*b*, and a base 12. The socket 10*a* and the ball 10*b* form part of a ball-and-socket joint, which allows a pilot to control the craft. A pair of handlebars 10*f* project from the socket 10*a*. The handlebars 10*f* comprises a section 10*e* that projects outwardly from the socket 10*a* and bends into a backward U-shape 10*d*. At an end of the handlebars 10*f* is a push button 10*g* that control the locking of both the steering column 10*c* and the socket 10*a*. The steering column 10*c* has a cylindrical bearing 10*i* and a pair of bearing shafts 10*h* projecting from the bearing 10*i*, as seen in FIG. 23. The bearing shafts 10*h* ride on an inner race 26*b* of a pair of ball bearings 26 with sensors 26*c*, which are housed in part of an outer race 26*a*, as seen in FIGS. 16-18. This sensors 26*c* detect when a ball bearing 26*d* has passed which detect the direction the steering column 10*c* has gone, which controls any of the jets. A pair of brackets 12*a* fasten the two sets of ball bearings 26. The brackets 12*a* are bolted to the base 12. As shown in FIGS. 3 and 9, the base 12 is fixed to a carriage 5*b* that is below the floor 5.

A button 10*z* on the left handlebar 11*a* is used to raise RPM of the engines like a turbo. The right side handlebar 10*f* rotates on its axis to throttle the engines by twisting the handlebar 11*a* forward for faster and backward for slower.

FIG. 9 shows the pedestal 5*a* including an oval opening 5*c* where the steering column 10*c* passes through, as seen in FIG. 3. FIG. 23 shows the steering column 10*c* contains a hydraulic brake system within the bearing 10*i*. A piston housing 10*j* is fastened to an opening 10*p* inside the bearing 10*i*. A piston 10*k* projects from the piston housing 10*j* which then creates braking against the base 12 when hydraulically activated. To retract the piston 10*k*, at least one tension spring 10*n* is connected to the piston 10*k* and the piston housing 10*j*. The ends of the tension springs 10*n* are wrapped to a pair of pegs 10*r*, 10*m* that respectively project from the piston housing 10*j* and piston 10*k*.

Figure 28:
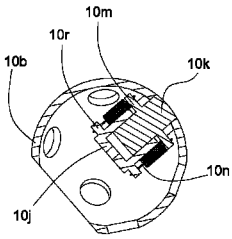
FIG. 28 shows cross-sectional view 28-28 showing the internals of the socket in FIG. 27.

FIGS. 22 and 24-28 show a steering brake system being part of the ball-and-socket joint similar to the hydraulic brake system within the bearing 10*i*. While it envisioned that both brake systems use hydraulics. The brake systems can be modified to use pneumatics or solenoid mechanism instead of hydraulics. The ball 10*b* includes spherically distributed openings 10*x*, which house sensing bearings 14. This reduces the friction normally created in ball-and-socket joints as well provide sensors 10*y* signals as they touch the sensors 10*y*. The advantage is that these sensing bearings 14 work in conjunction with sensors 10*y* that are embedded in the socket 10*a* to detect steering motion which then propels the craft 1 to the left or right, or launch the craft up with the bottom jet 4*e*. The sensor 10*y* are equally distributed as the openings 10*x* and are flush with an inner surface of the socket 10*a*. As seen in FIG. 28, the ball 10*b* is hollowed out and the brake system is located within the hollow ball 10*b*. The piston 10*k* projects out of the ball 10*b* to brake against the socket especially when button 10*g* is pressed during a tumble phase.

Figure 24:
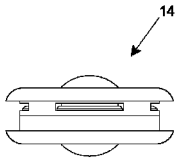
FIG. 24 shows a side view of a ball-bearing retaining system.
Figure 25:
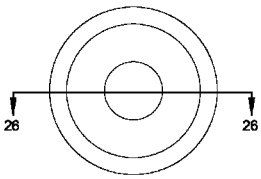
FIG. 25 shows a top view of the ball-bearing retaining system.
Figure 26:
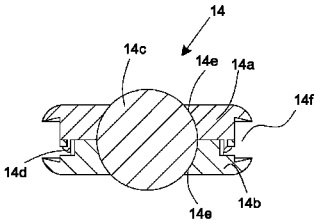
FIG. 26 shows cross-sectional view 26-26 shown in FIG. 25.
Figure 27:
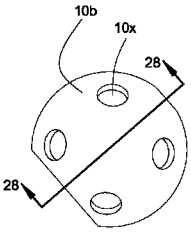
FIG. 27 shows a close up view of the socket used in the steering mechanism.

FIGS. 24-26 show the details of the sensing bearings 14, which are part of the socket 10*a*. The sensing bearings 14 comprise of two ball bearing housings 14*a*, 14*b*, which are connected together via a snap click connection 14*d*. Each of the ball bearing housings 14*a*, 14*b* contain a spherical opening 14*e* to keep a ball bearing 14*c* in place. Both ball bearing housings 14*a*, 14*b* together form a groove 14*f* that corresponds in shape to a spherical portion surrounding the opening 10*x*. It is envisioned that the ball bearings housing 14*a*, 14*b* are to be made of hard plastic or metal. Alternatively, while no preferred reference is made to any particular material, one skilled in the art can use any hard material that can withstand impact since this craft is a high velocity vehicle. It should be noted that the sensors 10*y*, 26*c* are connected to a control unit 40 utilizing logic chips to activate all the ports.

The invention claimed is:

1. A water propelled craft comprising an enclosed body including jet ports, a series of valves, and a control unit;

wherein an intake port being located at a bottom side of the body;

wherein one of the jet ports being located on a rear side of the body;

wherein another of the jet ports being located on the right side of the body;

wherein another of the jet ports being located on the left side of the body;

wherein the right side jet port and the left side jet port being controlled by the series of valves activated by the control unit;

wherein the valves are connected to servo motors that open and close the jets via solenoid switches;

wherein the enclosed body includes a steering mechanism comprising a ball-and-socket joint between a pair of handlebars and a steering column;

wherein the ball-and-socket joint includes a ball, a socket, and ball bearings embedded on the ball; and, wherein the ball bearings being contactable with a series of circuit sensors embedded on the socket connected to the control unit to control the servo motors.

2. The water propelled craft of claim 1, wherein the steering mechanism has a piston slidable from the ball to contact the socket for stabilizing the handlebars.

3. The water propelled craft of claim 1, the handlebars comprise a U-shape bend that projects upwardly to provide ergonomic hand control and safety grip in a tumble phase of the craft.

4. The water propelled craft of claim 1, the body further includes a seat with an recessed, overhead, retractable, pull-down frame, a body harness, and recessed feet holders containing removable snap-in feet cushions.

5. The water propelled craft of claim 1, the enclosed body comprises a stainless steel frame, a reinforced carbon fiber outer shell, and polymer view shields for making the enclosed body shock proof.

6. A water propelled craft comprising an enclosed body including jet ports, a series of valves, and a control unit;

wherein an intake port being located at a bottom side of the body;

wherein one of the jet ports being located on a rear side of the body;

wherein another of the jet ports being located on the right side of the body;

wherein another of the jet ports being located on the left side of the body;

wherein the right side jet port and the left side jet port being controlled by the series of valves activated by the control unit; and, the enclosed body includes an air intake port and a tumble sensor;

wherein the air intake port being channeled to a water check valve;

wherein the tumble sensor comprising an opaque filled transparent donut enclosing an air bubble;

wherein the tumble sensor further comprising a pair of laser beams and a pair of beam detectors; and;

wherein the beam detector is connected to the air intake port to open or close during a tumble phase.

7. The water propelled craft of claim 6, wherein the laser beams are respectively directed to the beam detectors to detect right tilt or left tilt of the craft.

8. The water propelled craft of claim 6, wherein the enclosed body including a pressurized air canister channeled to a carburetor of an engine to prevent the engine from stalling during periods of submersion.

9. The water propelled craft of claim 6, further comprising a water reservoir in line with the air intake port; and, wherein a sump pump is connected to the water reservoir to prevent flooding.

10. A water propelled craft comprising an enclosed body including jet ports, a series of valves, and a control unit;

wherein an intake port being located at a bottom side of the body;

wherein one of the jet ports being located on a rear side of the body;

wherein another of the jet ports being located on the right side of the body;

wherein another of the jet ports being located on the left side of the body;

wherein the right side jet port and the left side jet port being controlled by the series of valves activated by the control unit;

further comprising a bottom jet port located at the bottom of the body;

wherein the intake port comprises a telescoping bellows capped with a mesh grating; and, wherein the mesh grating includes at least one telescoping extender activated by a sensor which detects height level.

11. The water propelled craft of claim 1, wherein the steering column further includes a cylindrical bearing and bearing shafts projecting from the cylindrical bearing rotatable in ball bearings having sensors.

12. The water propelled craft of claim 11, wherein the cylindrical bearing includes a piston slidable from the cylindrical bearing to contact a base mounted to a floor of the craft for locking the steering column.

13. The water propelled craft of claim 10, wherein the jet port on the left side and the jet port on the right side are connected from a Y-channel.

14. The water propelled craft of claim 10, wherein the bottom jet port also includes a valve to be activated by the control unit.

15. The water propelled craft of claim 14, wherein the valves comprise butterfly valves that are pneumatic, hydraulic, or servo motor operated.

* * * * *